US009147945B2

(12) United States Patent
Sato

(10) Patent No.: US 9,147,945 B2
(45) Date of Patent: Sep. 29, 2015

(54) CRIMP TERMINAL

(75) Inventor: Kei Sato, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/395,574

(22) PCT Filed: Dec. 10, 2010

(86) PCT No.: PCT/JP2010/072723
§ 371 (c)(1),
(2), (4) Date: Mar. 12, 2012

(87) PCT Pub. No.: WO2011/071189
PCT Pub. Date: Jun. 16, 2011

(65) Prior Publication Data

US 2012/0178316 A1 Jul. 12, 2012

(30) Foreign Application Priority Data

Dec. 11, 2009 (JP) ..... 2009-281484

(51) Int. Cl.
*H01R 4/10* (2006.01)
*H01R 4/18* (2006.01)
*H01R 43/16* (2006.01)

(52) U.S. Cl.
CPC ..... *H01R 4/188* (2013.01); *H01R 43/16* (2013.01)

(58) Field of Classification Search
USPC ..... 439/421, 423, 442, 884, 877–882, 439/851–852
See application file for complete search history.

(56) References Cited

U.S. PATENT DOCUMENTS

| | | | | | |
|---|---|---|---|---|---|
| 3,553,347 | A * | 1/1971 | Harding et al. | ..... | 174/84 C |
| 3,761,872 | A * | 9/1973 | Ebinger | ..... | 439/882 |
| 3,989,339 | A * | 11/1976 | Haitmanek | ..... | 439/421 |
| 4,583,069 | A * | 4/1986 | Pierce | ..... | 337/240 |
| 4,863,391 | A * | 9/1989 | Mochizuki | ..... | 439/125 |
| 4,932,906 | A * | 6/1990 | Kaley et al. | ..... | 439/857 |
| 5,445,541 | A * | 8/1995 | May et al. | ..... | 439/595 |
| 5,736,678 | A * | 4/1998 | Kobayashi | ..... | 174/84 C |
| 5,897,405 | A * | 4/1999 | Endo | ..... | 439/852 |
| 6,290,556 | B1 * | 9/2001 | Howland et al. | ..... | 439/879 |
| 6,416,366 | B2 * | 7/2002 | Endo et al. | ..... | 439/851 |

(Continued)

FOREIGN PATENT DOCUMENTS

| | | | |
|---|---|---|---|
| CN | 1260609 | A | 7/2000 |
| CN | 101465478 | A | 6/2009 |

(Continued)

OTHER PUBLICATIONS

International Search Report dated Mar. 3, 2011 issued in International Application No. PCT/JP2010/072723 (PCT/ISA/210).

(Continued)

*Primary Examiner* — Thanh Tam Le
(74) *Attorney, Agent, or Firm* — Sughrue Mion, PLLC

(57) ABSTRACT

A crimp terminal includes a bottom portion. A pair of conductor press-fastening portions respectively extend from opposite side edges of the bottom portion. A serration is formed in a face of the bottom portion on which a conductor of a wire is to be placed. The serration extends in a direction perpendicular to an axial direction of the placed conductor. A direction indication mark portion is provided on the face of the bottom portion. The direction indication mark portion is indicative of a direction perpendicular to an extending direction of the serration.

10 Claims, 5 Drawing Sheets

(56) References Cited

U.S. PATENT DOCUMENTS

| | | | | |
|---|---|---|---|---|
| 6,447,345 | B2 * | 9/2002 | Sato et al. | 439/852 |
| 6,971,927 | B2 * | 12/2005 | Anbo et al. | 439/852 |
| 6,997,761 | B2 * | 2/2006 | Lutsch et al. | 439/891 |
| 7,144,281 | B2 * | 12/2006 | Maeda | 439/852 |
| 7,210,958 | B1 * | 5/2007 | Jacques et al. | 439/421 |
| 7,462,062 | B2 * | 12/2008 | Kumakura | 439/422 |
| 7,775,842 | B2 | 8/2010 | Yamagami | |
| 7,803,008 | B2 * | 9/2010 | Onuma | 439/442 |
| 8,177,590 | B2 * | 5/2012 | Tanaka et al. | 439/877 |
| 8,221,171 | B2 * | 7/2012 | Ono et al. | 439/877 |
| 2002/0022414 | A1 | 2/2002 | Kitagawa et al. | |
| 2009/0163088 | A1 | 6/2009 | Yamagami | |
| 2011/0028054 | A1 | 2/2011 | Tanaka et al. | |

FOREIGN PATENT DOCUMENTS

| | | | |
|---|---|---|---|
| GB | 2363525 | A | 12/2001 |
| GB | 2455655 | A | 6/2009 |
| JP | 29-16767 | Y | 12/1954 |
| JP | 56-104070 | U | 1/1980 |
| JP | 62-173162 | U | 11/1987 |
| JP | 10125362 | A | 5/1998 |
| JP | 2009-218189 | A | 9/2009 |
| WO | 2009/136560 | A1 | 11/2009 |

OTHER PUBLICATIONS

Written Opinion dated Mar. 3, 2011 issued in International Application No. PCT/JP2010/072723 (PCT/ISA/237).

Office Action dated Dec. 27, 2013, issued by the Japanese Patent Office in counterpart Japanese Application No. 2009-281484.

Office Action dated Sep. 17, 2013, issued by the Japanese Patent Office in counterpart Japanese Patent Application No. 2009-281484.

Office Action dated Dec. 4, 2013 issued by the State Intellectual Property Office of P.R. China in corresponding Chinese Patent Application No. 201080042000.8.

Office Action dated Jun. 3, 2014 issued by the State Intellectual Property Office of P.R. China in counterpart Chinese Patent Application No. 201080042000.8.

* cited by examiner

CRIMP TERMINAL

TECHNICAL FIELD

This invention relates to a crimp terminal to which a wire is crimped.

BACKGROUND ART

Various crimp terminals have been proposed (refer to PTL 1). One conventional example of the crimp terminals is shown in FIG. 4.

In FIG. 4, a crimp terminal 50 is made of an electrically-conductive material. The crimp terminal 50 includes a mating terminal connection portion 51 for connection to a mating terminal, and a wire crimping portion 52 to which a wire W is crimped.

The mating terminal connection portion 51 extends forwardly from a bottom portion 53 of the wire crimping portion 52. The wire crimping portion 52 includes the bottom portion 53, a pair of conductor press-fastening portions 54 projecting respectively from opposite side edges of the bottom portion 53, and a pair of sheath press-fastening portions 55 projecting respectively from the opposite side edges of the bottom portion 53. A conductor w1 of the wire W placed on the bottom portion 53 is crimped by deforming the pair of conductor press-fastening portions 54, and two portions of a sheath w2 of the wire W placed on the bottom portion 53 are crimped by deforming the pair of sheath press-fastening portions 55, whereby the wire W is crimped to the wire crimping portion 52.

Three serrations 56*a*, 56*b* and 56*c* which are grooves are formed in a face of the bottom portion 53 on which the conductor w1 of the wire W is to be placed, and are disposed at a region where the pair of conductor press-fastening portions 54 are formed. The serrations 56*a*, 56*b* and 56*c* are disposed at substantially equal intervals in an axial direction of the conductor w1, and extend in a direction perpendicular to the axial direction of the conductor w1.

It is thought that the serrations 56*a*, 56*b* and 56*c* have advantages such as: an effect of cleaning between the conductor w1 and the bottom portion 53; an enhanced electrical performance due to an increased area of contact between the conductor w1 and the bottom portion 53; and an enhanced wire holding force, that is crimping characteristic, due to biting of the serrations into the conductor w1 and so on.

The Applicant has found that by providing a construction, as shown in FIG. 5, for reducing a shearing force of opposite end-side serrations 56*a* and 56*c* against the conductor w1 and securing a strong wire holding force (see PTL 1). In the construction, a central serration 56*b* among the three serrations 56*a*, 56*b* and 56*c* has an inverted trapezoidal cross-sectional shape, and its inner and outer angles θ2 are the same. Each of the serrations 56*a* and 56*c* disposed respectively at the opposite end sides among the three serrations 56*a*, 56*b* and 56*c* has an inverted trapezoidal cross-sectional shape and is bilaterally asymmetrical that its outer angle θ1 is formed into an obtuse angle larger than its inner angle θ2.

In order to confirm whether or not the angles of the three serrations 56*a*, 56*b* and 56*c* have been set respectively to the above-mentioned desired angles, it is necessary to accurately measure the angles of the three serrations 56*a*, 56*b* and 56*c* formed in the bottom portion 53. In order to accurately measure the angles of each of the serrations 56*a*, 56*b* and 56*c*, it is necessary to cut the bottom portion 53 along a cutting line 60 parallel to a direction L perpendicular to the direction of extending of each serration 56*a*, 56*b*, 56*c* and then to measure the angles of each serration 56*a*, 56*b*, 56*c* utilizing its cut surface, as shown in FIG. 6.

CITATION LIST

[PTL 1] JP-A-10-125362

SUMMARY OF INVENTION

Technical Problem

In the above conventional crimp terminal 50, there is provided no means for specifying the direction L perpendicular to the extending direction of each serration 56*a*, 56*b*, 56*c*. Therefore a measurer has to suitably cut the bottom portion 53 by only visual inspection. Therefore, the bottom portion 53 may be cut along a cutting line 61 inclined relative to the direction L perpendicular to the extending direction of each serration 56*a*, 56*b*, 56*c*, as shown in FIG. 7. When the bottom portion 53 is cut along the cutting line 61 inclined relative to the accurate direction L, there is a problem that the angles of the serrations 56*a*, 56*b* and 56*c* can not be accurately measured.

It is therefore one advantageous aspect of the present invention is to provide a crimp terminal in which the angles of serrations can be accurately measured.

Solution to Problem

According to one aspect of the invention, there is provided a crimp terminal comprising:

a bottom portion;

a pair of conductor press-fastening portions respectively extending from opposite side edges of the bottom portion;

a serration formed in a face of the bottom portion on which a conductor of a wire is to be placed, and extending in a direction perpendicular to an axial direction of the placed conductor; and a direction indication mark portion provided on the face of the bottom portion and indicative of a direction perpendicular to an extending direction of the serration.

The direction indication mark portion may be a linear mark portion provided along the direction perpendicular to the extending direction of the serration.

The direction indication mark portion may be a slot formed through the bottom portion and extending along the direction perpendicular to the direction extending of the serration.

The crimp terminal may be configured such that: a plurality of the serrations are provided on the face of the bottom portion, the serrations are arranged in the axial direction of the placed conductor.

The crimp terminal may be configured such that: a pair of the slots are formed on the face of the bottom portion, the slots extend across the serrations, and the slots are arranged in the extending direction of the serrations.

The crimp terminal may be configured such that: two pairs of the linear mark portions are provided on the face of the bottom portion, the two pairs of the linear mark portions are respectively disposed each of outsides of a region between two of the serrations which are disposed at opposite end-sides, and the linear mark portions of each pair of the linear mark portions are arranged in the extending direction of the serrations.

Advantageous Effects of Invention

According to the present invention, by cutting the bottom portion on the basis of the direction indication mark portion, the bottom portion can be accurately cut in the direction perpendicular to the direction of extending of the serration, and therefore the angles of the serration can be accurately measured.

According to the present invention, the strength of the bottom portion will hardly or will not at all be decreased.

According to the present invention, the angles of the serration can be visually confirmed through the slot, and therefore the angles of the serration can be accurately measured without cutting the bottom portion.

DESCRIPTION OF EMBODIMENTS

Exemplified embodiments of the invention will be described below in detail with reference the accompanying drawings.

Figure 1:
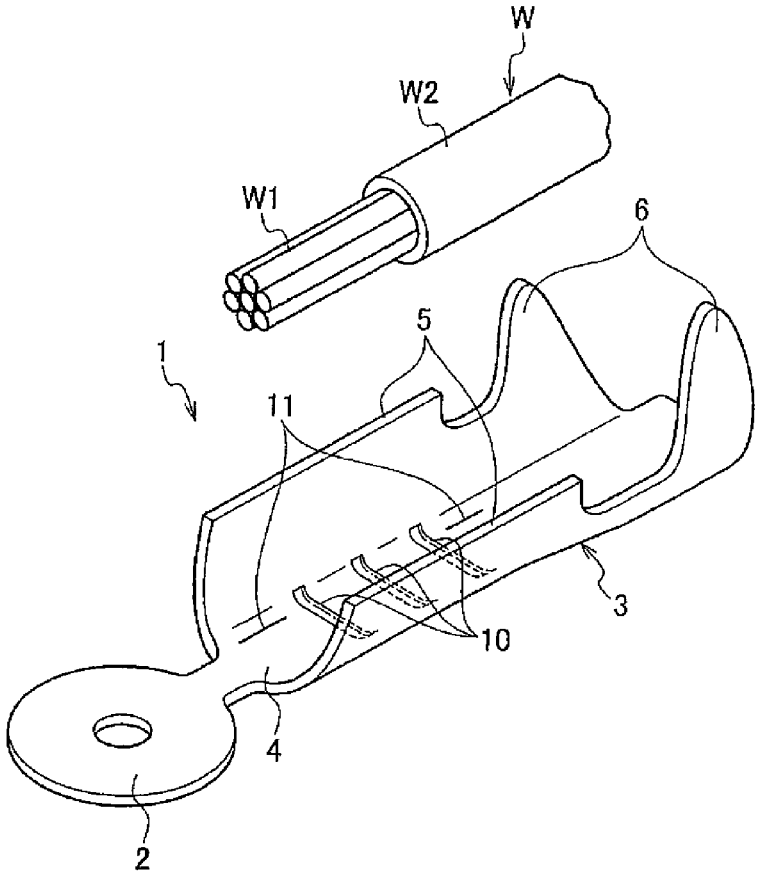
FIG. 1 is a perspective view of a crimp terminal in accordance with a first embodiment of the present invention.
Figure 2:
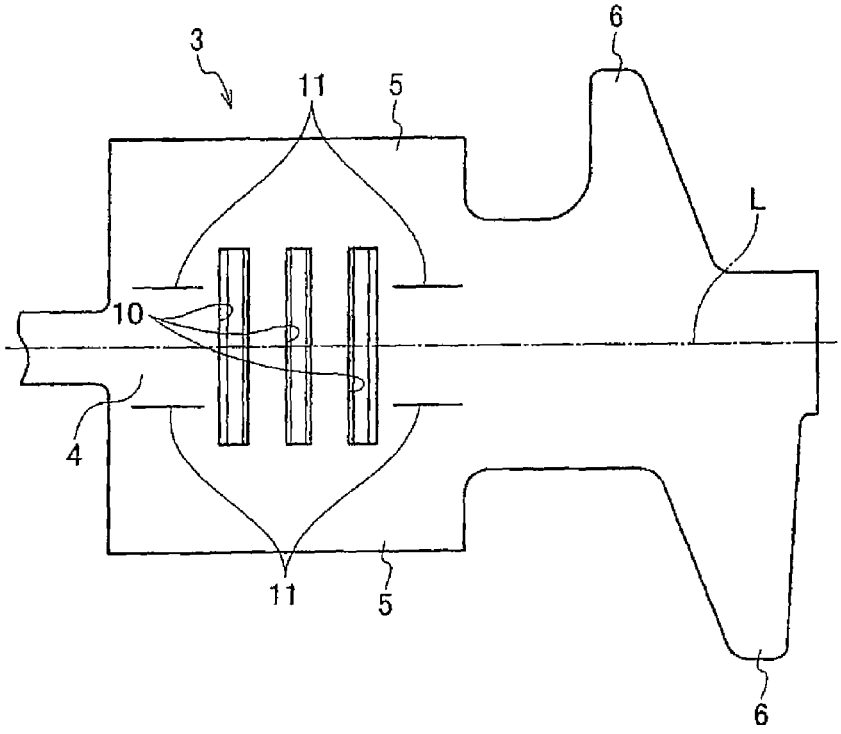
FIG. 2 is a developed view of a wire crimping portion of the crimp terminal shown in FIG. 1.

FIGS. 1 and 2 show a first embodiment of the present invention. FIG. 1 is a perspective view of a crimp terminal 1. FIG. 2 is a developed view of an important portion of a wire crimping portion 3 of the crimp terminal 1.

As shown in FIG. 1, the crimp terminal 1 is formed from an electrically-conductive material, and includes a mating terminal connection portion 2 for connection to a mating terminal, and the wire crimping portion 3 to which a wire W is crimped.

The mating terminal connection portion 2 is defined by a portion extending forwardly from a bottom portion 4 of the wire crimping portion 3. The wire crimping portion 3 includes the bottom portion 4, a pair of conductor press-fastening portions 5 projecting respectively from opposite side edges of the bottom portion 4, and a pair of sheath press-fastening portions 6 projecting respectively from the opposite side edges of the bottom portion 4. A conductor w1 of the wire W placed on the bottom portion 4 is crimped by deforming the pair of conductor press-fastening portions 5 due to the press-fastening, and two portions of a sheath w2 of the wire W placed on the bottom portion 4 are crimped by deforming the pair of sheath press-fastening portions 6 due to the press-fastening, whereby the wire W is crimped to the wire crimping portion 3.

Three serrations 10 are formed in a face of the bottom portion 4 on which the conductor w1 of the wire W is to be placed. The serrations 10 may be grooves. The serrations 10 are disposed at a region where the pair of conductor press-fastening portions 5 are formed. These serrations 10 are disposed at substantially equal intervals in an axial direction of the conductor w1, and extend in a direction perpendicular to the axial direction of the conductor w1.

Linear mark portions 11 which are direction indication mark portions indicative of a direction L perpendicular to an extending direction of the serrations 10 are provided on the face of the bottom portion 4 on which the wire W is to be placed. The linear mark portions 11 are provided by making fine linear scratches on the face of the bottom portion 4 or by forming colored linear marks on the face of the bottom portion 4. Two pairs of the linear mark portions 11 are provided on the face of the bottom portion 4. The pairs of the linear mark portions 11 are respectively disposed each of outsides of a region between the opposite end-side serrations 10. The linear mark portions 11 of each pair of the linear mark portions 11 are arranged in the extending direction of the serrations.

For measuring angles between each side surface of each of the serrations 10 and the bottom portion 4, the bottom portion 4 is cut along an extending direction of the linear mark portions 11. Accordingly the bottom portion 4 can be cut accurately and easily in the direction L perpendicular to the extending direction of each serration 10. Therefore the angles of each serration 10 can measured accurately and efficiently.

The direction indication portions are formed by the linear mark portions 11 respectively. Therefore the strength of the bottom portion 4 can be maintained.

Figure 3:
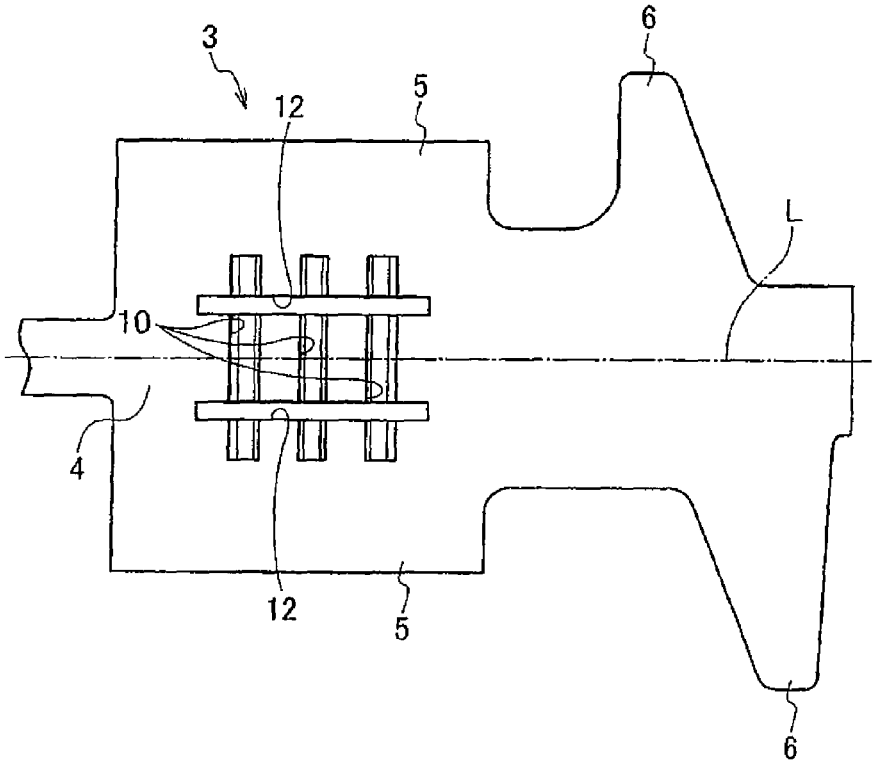
FIG. 3 is a developed view of a wire crimping portion of a crimp terminal in accordance with a second embodiment of the present invention.
Figure 4:
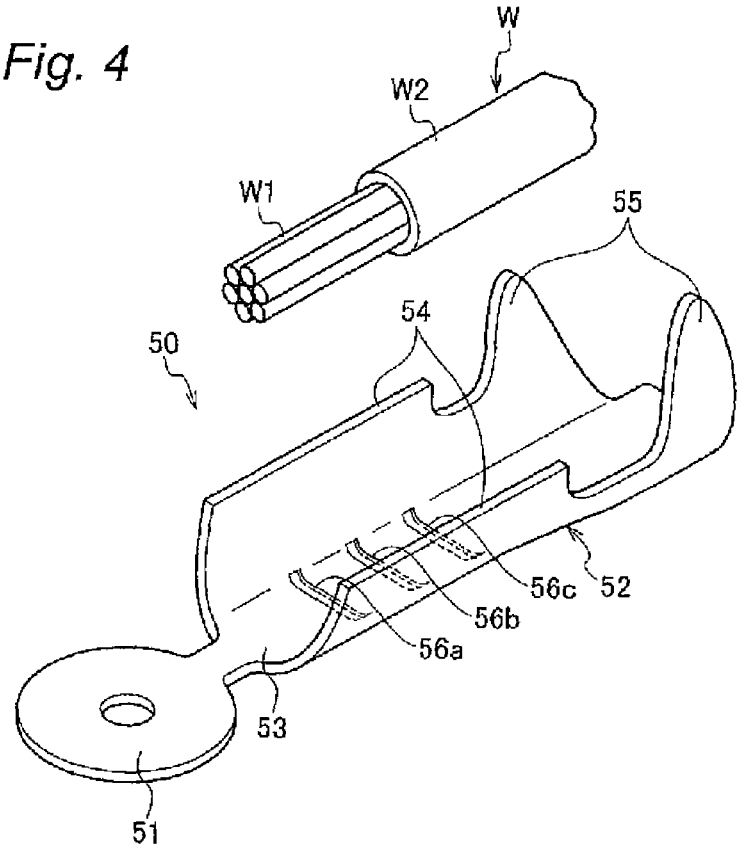
PRIOR ART Fig. 4
FIG. 4 is a perspective view of a conventional crimp terminal.
Figure 5:
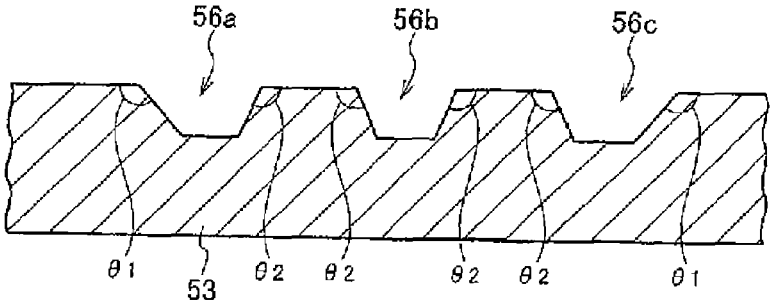
Fig. 5 PRIOR ART
FIG. 5 is a cross-sectional view of a bottom portion of a wire crimping portion of the conventional crimp terminal shown in FIG. 4.
Figure 6:
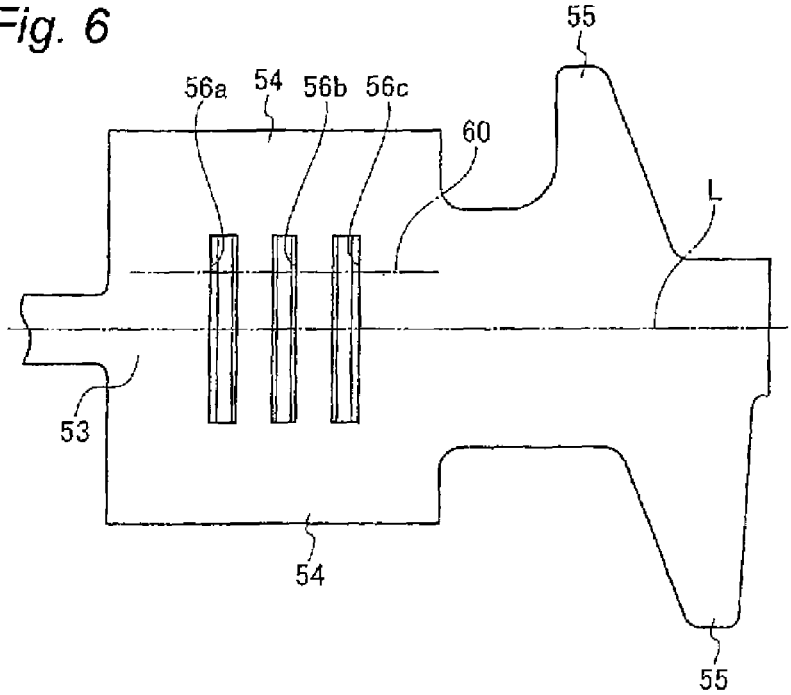
PRIOR ART Fig. 6
FIG. 6 is a view of the conventional crimp terminal shown in FIG. 6, showing a cutting line extending along a direction perpendicular to a direction of extending of serrations.
Figure 7:
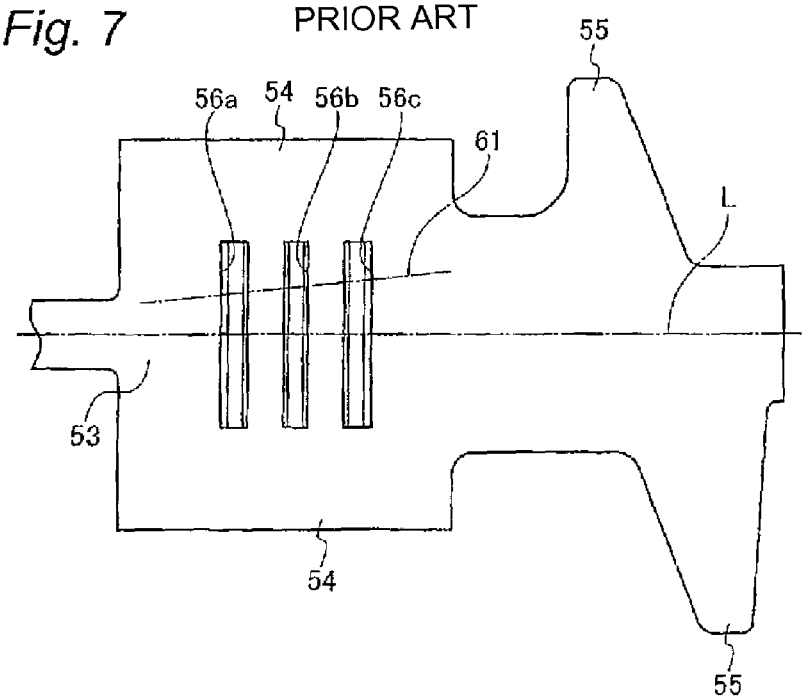
Fig. 7 PRIOR ART
FIG. 7 is a view of the conventional crimp terminal shown in FIG. 6, showing a cutting line inclined relative to the direction perpendicular to the direction of extending of the serrations.

FIG. 3 is a developed view of an important portion of a wire crimping portion 3 of a crimp terminal 1 in accordance with a second embodiment of the present invention.

The crimp terminal 1 of this second embodiment differs from the crimp terminal of the above first embodiment only in the construction of direction indication mark portions.

The direction indication portions of the second embodiment are respectively slots 12 formed through a bottom portion 4 and extending along a direction L perpendicular to the extending direction of each serration 10. The slots 12 are formed to extend across the three serrations 10. A pair of the slots 12 is formed respectively at right and left portions of the bottom portion 4 so as to be arranged in the extending direction of the each serration 10.

The other construction is the same as that of the first embodiment, and therefore repeated description will be omitted. In the drawings, those portions identical in construction respectively to the corresponding portions of the first embodiment are designated by identical reference numerals, respectively, for clear understanding.

When measuring the angles of each serration 10, the angles of each serration 10 can be visually confirmed utilizing the slots 12 by the cross-sectional shape of the each serration 10. Therefore a measuring operation can be effected without cutting the bottom portion 4. The angles of each serration 10 which can be viewed from the slot 12 are the angles in a direction L perpendicular to the direction of extending of each serration 10. With the above construction, the angles of the serrations 10 can be accurately measured without cutting the bottom portion 4. In addition, the measuring operation can be carried out efficiently since it is not necessary to cut the bottom portion 4.

In each of the above embodiments, although the three serrations 10 are provided at the bottom portion 4, any desired number of the serrations may be provided. Furthermore, the serrations 10 may extend beyond the bottom portion 4 into the conductor press-fastening portions 5.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The present application is based on Japanese Patent Application No. 2009-281484 filed on Dec. 11, 2009, the contents of which are incorporated herein for reference.

INDUSTRIAL APPLICABILITY

The present invention is extremely useful in providing a crimp terminal in which the angles of serrations can be accurately measured.

REFERENCE SIGNS LIST

1 crimp terminal
4 bottom portion,
5 conductor press-fastening portion
10 serration
11 linear mark (direction indication mark portion)
12 slot
W wire
w1 conductor

The invention claimed is:

1. A crimp terminal comprising:
a bottom portion;
a pair of conductor press-fastening portions respectively extending from opposite side edges of the bottom portion;
more than two serrations located proximately at a center of the conductor press-fastening portions and formed in a face of the bottom portion on which a conductor of a wire is to be placed, and each of the serrations extending in a direction perpendicular to an axial direction of the conductor; and
a direction indication mark portion provided on the face of the bottom portion and indicative of a direction perpendicular to an extending direction of the more than two serrations,
wherein the direction indication mark portion includes a pair of direction indication marks which are positioned respectively at right and left portions of a region where the serrations are located, and are provided approximately on a line perpendicular to the extending direction of the serrations, and
wherein the pair of direction indication marks are visibly processed portions formed in the face of the bottom portion and are provided at a location other than bending lines of the bottom face.

2. The crimp terminal according to claim 1, wherein
the direction indication marks are linearly provided along the direction perpendicular to the extending direction of the serrations.

3. The crimp terminal according to claim 2, wherein
the serrations are provided on the face of the bottom portion,
the serrations are arranged in the axial direction of the conductor, wherein the crimp terminal includes a second pair of direction indication marks provided on the face of the bottom portion so as to include two pairs of direction indication marks,
the two pairs of direction indication marks being respectively disposed at the region of the serrations and respectively disposed at opposite end-sides of the bottom portion.

4. The crimp terminal according to claim 1, wherein
the direction indication marks are slots respectively formed through the bottom portion and extending along the direction perpendicular to the extending direction of the serrations.

5. The crimp terminal according to claim 4, wherein
the slots extend across the serrations.

6. The crimp terminal according to claim 1, wherein the visibly processed portions comprise linear scratches in the face of the bottom portion.

7. The crimp terminal according to claim 1, wherein the direction indication marks do not contact the serrations.

8. The crimp terminal according to claim 1, wherein the direction indication marks have a color different than that of the bottom face.

9. A crimp terminal comprising:
a bottom portion;
a pair of conductor press-fastening portions respectively extending from opposite side edges of the bottom portion;
at least two serrations formed in a face of the bottom portion on which a conductor of a wire is to be placed, and each of the serrations extending in a direction perpendicular to an axial direction of the conductor; and
a pair of direction indication mark portions provided on the face of the bottom portion and indicative of a direction perpendicular to an extending direction of the at least two serrations,
wherein each direction indication mark portion of the pair of the direction indication mark portions includes a pair of linear marks such that there are two pairs of linear marks, the linear marks being provided along the axial direction of the conductor,
wherein the serrations are provided on the face of the bottom portion,
wherein the serrations are arranged in the axial direction of the conductor,
wherein the two pairs of the linear marks are provided on the face of the bottom portion and are respectively disposed outside of a region of the serrations and at opposite end-sides, and
wherein the linear marks are arranged in the extending direction of the serrations, and
wherein the two pairs of linear marks are visibly processed portions formed in the face of the bottom portion and are provided at a location other than bending lines of the bottom face.

10. A crimp terminal comprising:
a bottom portion;
a pair of conductor press-fastening portions respectively extending from opposite side edges of the bottom portion;
a plurality of serrations formed in a face of the bottom portion on which a conductor of a wire is to be placed, and each of the serrations extending in a direction perpendicular to an axial direction of the conductor; and
a direction indication mark portion provided on the face of the bottom portion and indicative of a direction perpendicular to an extending direction of the serrations,
wherein the direction indication mark portion comprises a slot formed through the bottom portion and extending along the axial direction of the conductor,
wherein the plurality of the serrations are arranged along the axial direction of the conductor,
wherein the crimp terminal comprises a second slot, and
wherein the slot and the second slot are formed on the face of the bottom portion and are provided at a location other than bending lines of the bottom face, the slot and the second slot extending across the serrations.

* * * * *